US006688567B2

(12) United States Patent
Fast et al.

(10) Patent No.: US 6,688,567 B2
(45) **Date of Patent: *Feb. 10, 2004**

(54) LABEL AND/OR SIGN HOLDER AND ADAPTOR

(75) Inventors: Jacob Fast, Boca Raton, FL (US); Michael G. Lowry, Boca Raton, FL (US); Robert Fast, Ft. Lauderdale, FL (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/222,775

(22) Filed: Aug. 19, 2002

(65) Prior Publication Data

US 2003/0098400 A1 May 29, 2003

Related U.S. Application Data

(60) Provisional application No. 60/332,541, filed on Nov. 26, 2001.

(51) Int. Cl.[7] ..... A47B 96/06; A47G 29/00

(52) U.S. Cl. ..... 248/220.41; 248/220.42; 248/220.22; 248/238.1; 211/57.1; 211/59.1; 40/661.03; 40/642.01; 40/642.02

(58) Field of Search ..... 248/220.41, 220.42, 248/479, 238.1, 220.22, 444.1; 40/661.03, 642.01, 642.02; 211/57.1, 59.1, 86.01

(56) References Cited

U.S. PATENT DOCUMENTS

| | | | | | |
|---|---|---|---|---|---|
| 3,320,690 | A | * | 5/1967 | Forsburg | 40/650 |
| 4,531,311 | A | * | 7/1985 | Howard et al. | 40/649 |
| 4,557,064 | A | | 12/1985 | Thompson | |
| 4,866,868 | A | * | 9/1989 | Kass | 40/661 |
| 5,044,104 | A | * | 9/1991 | Hopperdietzel | 40/654.01 |
| 5,263,269 | A | * | 11/1993 | Tjarnlund | 40/5 |
| 5,392,547 | A | * | 2/1995 | Mason | 40/661.06 |
| 5,488,793 | A | | 2/1996 | Gebka et al. | |
| 5,515,632 | A | | 5/1996 | Gebka et al. | |
| 5,678,699 | A | * | 10/1997 | Gebka | 211/57.1 |
| 5,899,011 | A | | 5/1999 | Brinkman | |
| 5,992,072 | A | * | 11/1999 | Garfinkle | 40/661.03 |
| 6,026,603 | A | | 2/2000 | Kump et al. | |
| 6,035,569 | A | | 3/2000 | Nagel et al. | |
| D423,592 | S | | 4/2000 | Wamsley | |
| 6,082,687 | A | | 7/2000 | Kump et al. | |
| 6,105,295 | A | | 8/2000 | Brinkman et al. | |
| 6,119,990 | A | | 9/2000 | Kump et al. | |
| 6,126,125 | A | * | 10/2000 | Dalton | 248/205.2 |
| D443,311 | S | | 6/2001 | Wildrick | |
| 6,263,603 | B1 | | 7/2001 | Wildrick | |
| 6,266,906 | B1 | * | 7/2001 | Nagel | 40/661.03 |
| 6,321,475 | B1 | * | 11/2001 | Glanz | 40/661 |
| 6,341,755 | B1 | * | 1/2002 | Kump | 248/220.41 |
| 6,354,546 | B1 | * | 3/2002 | Mueller | 248/220.42 |
| 6,357,154 | B1 | * | 3/2002 | Pfendler et al. | 40/661.03 |
| 6,470,613 | B1 | * | 10/2002 | Wildrick | 40/661.03 |
| 6,553,702 | B1 | * | 4/2003 | Bacnik | 40/661.03 |
| 6,568,112 | B2 | * | 5/2003 | Lowry et al. | 40/661.03 |
| 6,568,113 | B1 | * | 5/2003 | Valiulis | 40/661.06 |
| 6,622,410 | B2 | * | 9/2003 | Wilkes et al. | 40/661.03 |

FOREIGN PATENT DOCUMENTS

| | | | |
|---|---|---|---|
| WO | WO9105324 | * | 4/1991 |

* cited by examiner

*Primary Examiner*—Kimberly Wood
(74) *Attorney, Agent, or Firm*—Jacobson Holman PLLC

(57) ABSTRACT

A label holder or label/sign holder to be secured to a merchandise-supporting shelf devoid of a C-channel on its depending front lip. An adaptor element is secured to the supporting surface of the shelf as by push pins and has a forwardly extending portion defining a hook member engageable in a lip member defined at the upper edge of the body panel of the label holder without interfering with movement of a transparent cover member on the label holder to insert or remove labels from a pocket defined therebetween. Various embodiments of rearwardly extending flanges on the back of the body panel are adapted to secure the lower portions of the label holder to or around a rearwardly extending flange on the bottom of the shelf lip.

56 Claims, 6 Drawing Sheets

LABEL AND/OR SIGN HOLDER AND ADAPTOR

This is a complete application claiming benefit of provisional application Ser. No. 60/332,541, filed Nov. 26, 2001.

BACKGROUND OF THE INVENTION

1. Field of the Invention

This invention relates to merchandising aids, and relates more particularly to the manner and means by which a label holder or a combination label holder/sign holder is secured to a merchandising shelf, particularly a merchandising shelf devoid of a "C-channel" along its front edge. The label holder portion of the merchandising aid is designed to removably receive non-adhesive labels to display consumer information such as descriptions and prices of products on the shelf, as well as inventory control information, such as barcodes and the like. The sign holder portion of the merchandising aid, if included, is adapted to carry a "flag" or sign displaying special information to the consumer, such as identifying a "sale" item or the like. For simplicity, the terms "label holder" and "label/sign holder" are used interchangeably to include label holders with or without one or more means to also carry a sign or flag as discussed below.

2. Description of the Related Art

Shelves with "C-channels" along the front edge are commonly found in merchandise outlets such as supermarkets, pharmacies and the like, the C-channel being formed with spaced upper and lower opposed lips to provide a convenient means for mounting many different kinds of fit-in articles, such as labels, signs or sign holder which provide information relating to the merchandise displayed on the shelf. While adhesive-backed labels can be secured directly to such a surface, removing such adhesive-backed labels is time consuming and difficult, leaving an unsightly residue build-up which is resistant to cleaning. Generally, non-adhesive paper or plastic labels are preferred since they can easily be replaced if they become damaged or the product information changes. Therefore, label holders have been provided which commonly have a back or body panel attached in some fashion to the supporting surface, with a transparent cover member flexibly secured along one mating edge to the body panel to define a pocket between the front surface of the body panel and the rear surface of the cover member for removable reception of one or more such information-containing labels.

Label holders are generally provided in elongated sections, perhaps 4' or more in width, and may be secured by adhesive strips or the like to any supporting surface such as the side of a shelving or warehouse unit. However, most applications for such label holders are directly on the front flange or in the C-channel of the front edge of a product display shelf. Various prior art embodiments of such label holders can be seen in U.S. Pat. Nos. 4,713,899, 5,458,307, 5,488,793, 5,515,632, 5,682,698, 5,899,011 and 6,105,295, the disclosures of which are incorporated herein in their entireties by reference.

Oftentimes, in addition to the information provided by the product labels, it is desired to highlight certain information about a particular product or group of products by displaying an enlarged "flag" or sign on the shelf, depending from the portion of the shelf carrying such products, or extending into the aisle at such a location. Different forms of "sign holders" are also well known in the merchandising art, examples of which can be seen in the aforementioned U.S. Pat. No. 5,488,793, as well as U.S. Pat. Nos. 4,485,575, 4,531,313, 4,625,441, 4,704,813, 4,917,342, 4,995,182, 5,682,698, and 6,163,996, the disclosures of which are also incorporated herein in their entireties by reference.

Separate sign holders can simply be positioned on the shelf itself, or juxtaposed to the shelf in the aisle. Yet, such an arrangement may not be stable, can waste valuable product display space, and can even cause damage to consumers. For that reason, as seen in some of the aforementioned patents, such sign holders may be designed to be supported partially or entirely in the same C-channels as the label holders.

While constructions of this nature are convenient for many applications, significant difficulties are encountered when it is necessary to insert new labels or to remove or replace labels already carried in the underlying label holder. In order to access the label holder pocket, any and all sign holders secured in front of and, therefore, overlying the label holder must first be removed, and subsequently replaced. This is time consuming, labor intensive, and obviously inefficient, particularly when using elongated label holders that may have multiple sign holders engaged along their length.

Pending U.S. application Ser. No. 09/907,588 filed Jul. 19, 2001 (the '588 application), the subject matter of which is also incorporated herein in its entirety by reference, provides a combination label/sign holder wherein the sign holders are carried by, and move with, the cover member and do not interfere with access to the label holder pocket so that labels can be selectively inserted and removed from the label holder pocket without removing any of the sign holders associated with related products. More specifically, in the '588 application, the front surface of the cover member of the label holder is provided with a pair of sign holder-receiving lip members which can snappingly receive edge portions of a resilient plastic or metal sign holder such as seen in aforementioned U.S. Pat. No. 5,488,793, or the engaging portions of a depending sign holder of the type seen in aforementioned U.S. Pat. Nos. 5,682,698 and 6,163,996, or other such commercially available sign holders. The combination label/sign holder of the '588 application also includes a locking construction to secure paper or the like labels in the pocket, with a ledge or other finger-engaging element adapted to facilitate opening the label holder for insertion or removal of labels from the pocket as seen particularly in aforementioned U.S. Pat. No. 5,515,632.

Some merchandising shelves do not have integral C-channels and have only a downwardly depending or downwardly and forwardly angled front edge or lip terminating in a rearwardly-directed lower flange. Attachment of a label holder or a combination label/sign holder to a merchandise shelf devoid of an integral C-channel is problematic. While label or label/sign holders can be adhesively secured to the depending lip on shelves of this nature, moving or replacing such elements, as with the adhesively-backed labels themselves, is difficult, time consuming and leaves an unsightly residue that is resistant to cleaning. Attempts to avoid the adhesive attachment with various elements fixing the lower portion of the label holder to or around the rearwardly extending flange on the bottom of the shelf have been generally unsuccessful because they cannot retain the body panel in position against the front edge of the shelf when the cover member is tipped forwardly to insert or remove a label from the pocket.

SUMMARY OF THE INVENTION

A primary object of this invention is the provision of means designed to facilitate attaching a label holder such as seen, for example, in U.S. Pat. No. 5,515,632, and/or a combination label/sign holder, such as seen, for example, in the '588 application, to a merchandising shelf of the type described above lacking a C-channel.

Another object of this invention is to provide an adaptor element which can be fixed to the top of the shelf, such as by one or more integrally extruded or independent fasteners such as "push pin" members or the like snappingly engaged in the apertures commonly defined in the supporting surfaces of such shelves, with a forwardly extending reverted front edge or "hook" member adapted to engage with upper portions of the body panel of the label holder to secure the same in position. Such adaptor elements preferably have a unique form of integral push pin designed to snappingly engage in both round and diamond-shaped openings found on shelves of this nature.

Yet another object of this invention is to provide an adaptor element which secures the upper portions of the body panel of a label holder without interfering with the ability of the cover member to move relative to the body panel to open a pocket formed between these elements for reception or removal of a label as necessary.

A further object of this invention is the provision of a label holder assembly including an adaptor element as discussed above to secure the upper portions of the body panel with various elements adapted to underlie or wrap around the rearwardly extending lower shelf flange to secure the lower portions of the label holder.

Yet another object of this invention is the provision of a label holder assembly as described adapted to cooperate with a unique clip member to secure the lower portions of the label holder to the rearwardly extending shelf flange.

Other and further objects, features and advantages of the invention will become apparent from the ensuing description and claims taken in conjunction with the attached drawings.

BRIEF DESCRIPTION OF THE DRAWINGS

Like reference characters refer to like parts throughout the several views of the drawings.

DESCRIPTION OF THE PREFERRED EMBODIMENTS

Figure 1:
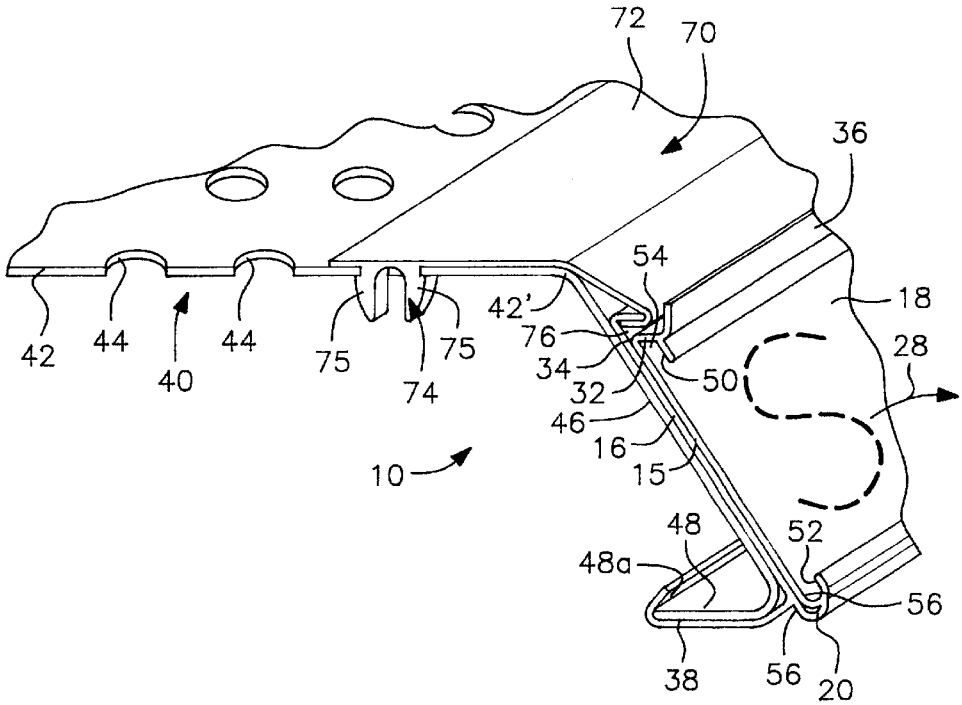
FIG. 1 is a fragmentary cross-sectional view through one embodiment of a combined label/sign holder according to this invention affixed to the front edge or lip of a shelf with no C-channel by an adaptor element as discussed above secured to the round holes in the shelf supporting surface.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 3:
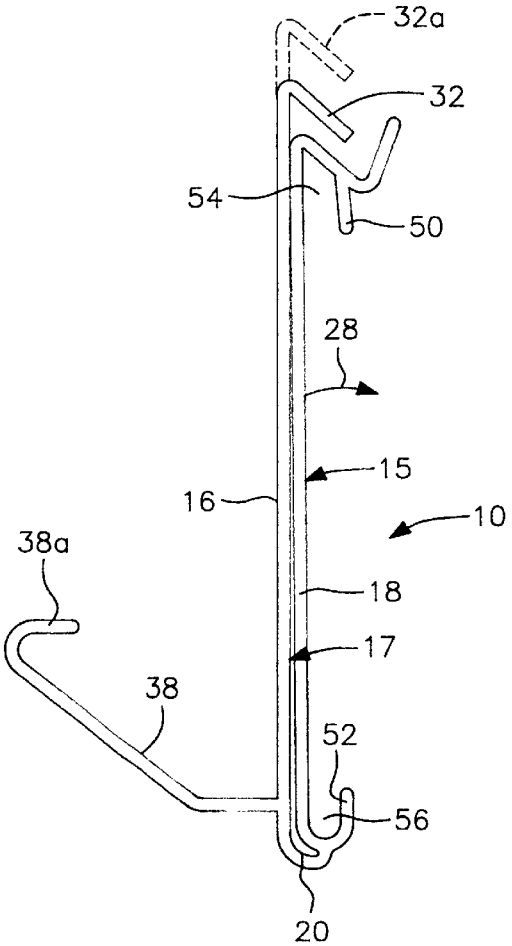
FIG. 3 is a side elevational view of the label/sign holder of FIG. 1, with an additional body panel lip shown in dotted lines for use in the embodiment of FIG. 2.

Referring generally to FIGS. 1 and 3, one embodiment of a merchandising aid in the nature of a combined label/sign holder such as seen in the '588 application is designated generally by the reference numeral 10. The merchandising aid 10 includes a label holder portion 15 formed by a back or body panel 16 and a cover member 18 flexibly secured to each other at a hinge or pivot portion 20. The material from which the merchandising aid is made is not critical to the instant inventive concepts, although commercially such products are commonly co-extruded from plastics materials, with the body panel 16 being formed of an opaque plastic and the cover member 18 being formed of a transparent material to enable passers-by to view information on a label (not shown) captured in a pocket 17 formed between the front surface of the body panel 16 and the rear surface of the cover member 18. The cover member 18 can be tipped forwardly in the direction of the arrow 28 to facilitate the insertion or removal a label. The resilient nature of the hinge 20 will then normally bias the cover member 18 back to its closed position to retain the label in the pocket 17 in a well known manner.

In a preferred embodiment, the upper edge portions of the base panel 16 include a forwardly and downwardly extending flange or lip 32 and the upper edge portions 34 of the cover member 18 are lockingly engageable under the body panel lip 32 to retain the cover member and secure a label in the pocket 17, particularly in the event the resilience of the connection between the base panel 16 and the cover member 18 weakens with continued use of the label holder 15. A downwardly and then forwardly and upwardly extending finger-engaging element 36 is preferably carried by the upper edge portions 34 of the cover member 18 to facilitate release of the upper edge portions 34 of the cover member 18 from the locking engagement with the flange 32 of the base panel 16.

As mentioned above, the cover member 18 of the label holder portion 15 of the '588 application carries a sign holder such that the label holder can be opened without removing the sign holder. To that end, a pair of sign holder-receiving lip members 50, 52 are integrally formed on the cover member 18, i.e., by extrusion. The upper sign holder-receiving lip member 50 extends forwardly and downwardly from the upper edge portions 34 of the cover member 18 behind the finger-engaging element 36 to form an upper sign holder-receiving pocket 54, and the lower sign holder-receiving lip member 52 extends forwardly and upwardly from the lower edge portions of the cover member 18 to define a lower sign holder-receiving pocket 56.

One well-known spring clip form of sign holder (not shown) includes a spring plastic or metal element having oppositely extending edge portions adapted to be snappingly engaged in the sign holder-receiving pockets 54, 56, respectively, in an obvious manner. Such sign holders have a central slit or opening adapted to grippingly engage a plastic or cardboard "flag" or sign (not shown). A different form of sign holder is seen, for example, in the aforementioned U.S. Pat. Nos. 5,682,698 and 6,163,996, and the label/sign holder 10 can likewise accommodate such items enabling the substitution of labels, with no need to remove the sign holder since it is carried by, and moves with, the cover member 18.

The merchandising aid 10 can be of any dimensions, but, as noted above, is generally marketed in elongated sections which can receive and retain multiple labels, each of which is adapted to contain consumer and inventory information related to products on a merchandise shelf and display such information to passers-by or store personnel through the transparent cover member 18. The flag or sign, on the other hand, in a sign holder is extended into the aisle or downwardly below the shelf in a manner to more prominently display special product information to consumers passing in either direction. By supporting the sign holder directly on the cover member 18 of the label holder portion 15 of the merchandising aid 10, the cover member 18 can be tilted forwardly for insertion or removal of a label without interference from the sign holder, since the sign holder with its accompanying sign remains in position on the cover member 18 and moves therewith. In this manner, it is possible for store personnel to readily remove or replace new labels at any point along the length of a section of label holder without removing any or all of the sign holders associated therewith.

For all intents and purposes the label/sign holder 10 seen in FIG. 1 is substantially identical to the preferred label/sign holder of the '588 application. However, in order to enable the label/sign holder 10 disclosed herein to be attached to a merchandise shelf 40 commonly formed of metal and including a generally horizontally-extending product or merchandise support section 42 having a front edge 42' and generally including a multiplicity of uniformly spaced rows of through-apertures 44 shown as circular in FIG. 1, a forwardly and downwardly depending or shelf lip 46 devoid of a C-channel, and a rearwardly extending lower shelf flange 48, the label/sign holder 40, is modified to include means to engage the bottom of the label holder with the shelf flange 48 of the shelf 40, and an adaptor element, one embodiment of which is seen at 70 in FIGS. 1, 3 and 4, is provided to secure the top of the label holder to the shelf.

More specifically, in the embodiment of FIGS. 1 and 3, a rearwardly extending lower flange 38 with a reverted rear edge 38*a* is integrally formed with the body panel 16 to underlie and extend around the rear edge 48*a* of the shelf flange 48. The adaptor 70 is preferably formed of a semi-opaque polypropylene, although other materials can be readily substituted therefor and comprises a generally flat sheet of plastics material, including a generally planar rear portion 72 and a forward portion defining a reverted front edge or hook member 76 adapted to engage with the downwardly extending body panel lip 32 as seen particularly in FIG. 1.

The rear end portion of the adaptor 70 is provided with one or more integrally extruded fasteners such as "push pin" members 74 having spaced leg members 75 resiliently secured to the undersurface of the adaptor 70 at sections of reduced cross section 75' merging with larger sections 75" tapering to freely extending tips. The spacing between the larger sections 75" is greater than the dimension of the openings 44 transverse to the front edge 42' of the shelf 40 while the spacing between the reduced cross section portions 75' is less than the dimension of the apertures 44. In this manner, the push pins 74 can be snappingly engage in one or more of the apertures 44 of the shelf 40, usually in the first row of apertures 44, but possibly in a more rearward row, thereby securing the label/sign holder 10 in position.

In lieu of the integral push pins 74, the planar section 72 of the adaptor 70 could be provided with openings or weakened points (not shown) through which more conventional discrete plastic or other such spring-type fasteners, dart clips or push pins (not shown) can be inserted into the openings 44 of the shelf 40 to retain the adaptor 70 and, thereby, the upper portions of the label/sign holder 10 on the front edge 46 of the shelf 40.

Figure 1A:
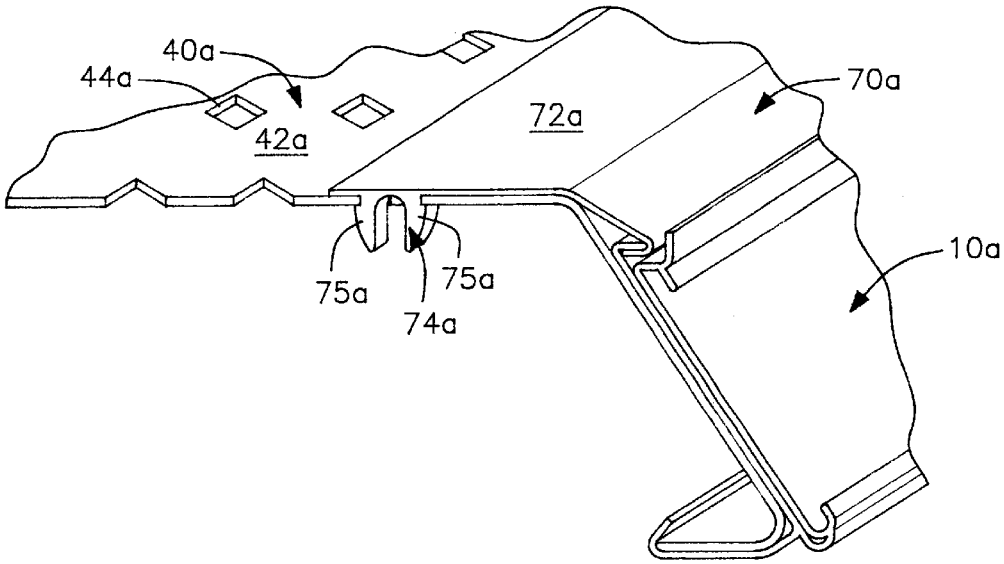
FIG. 1A is a view similar to FIG. 1, but showing a modified adaptor element having an integral "push pin" for engagement in the round holes formed of a shelf as seen in FIG. 1, or the diamond-shaped holes in a shelf as seen in FIG. 1A.
Figure 4A:
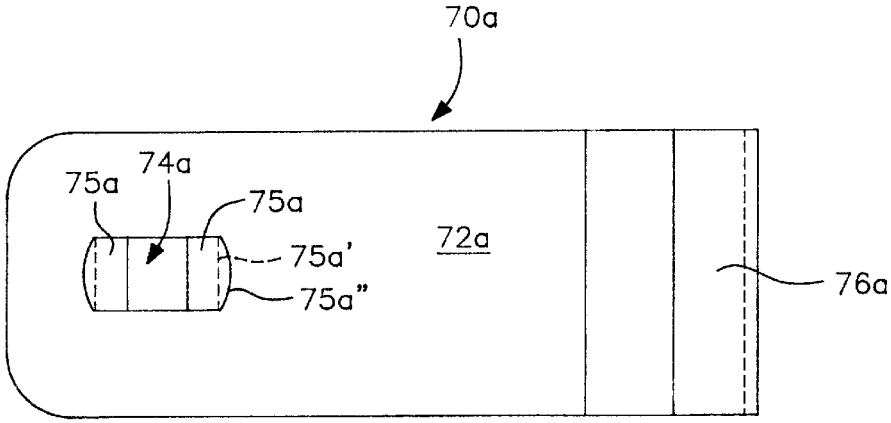
FIG. 4A is a bottom plan view of a modified adaptor element with "push pin" elements designed for engagement in either round or diamond-shaped holes through the product supporting surface of a shelf.
Figure 5A:
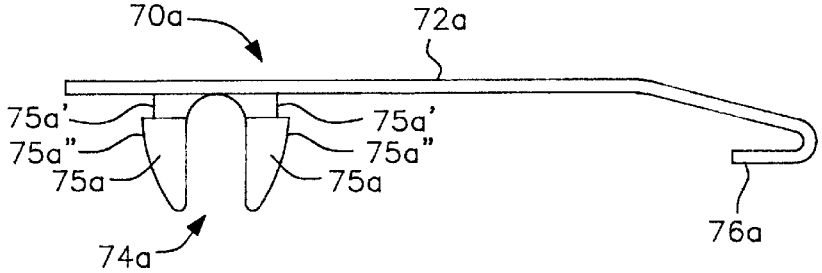
FIG. 5A is a side elevational view of the adaptor element of FIG. 4A.
Figure 4:
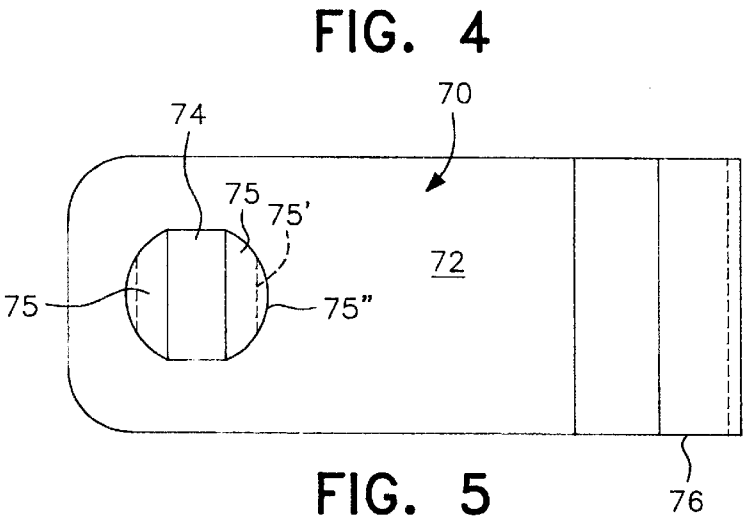
FIG. 4 is a bottom plan view of the adaptor element as seen in FIGS. 1 and 2.
Figure 5:
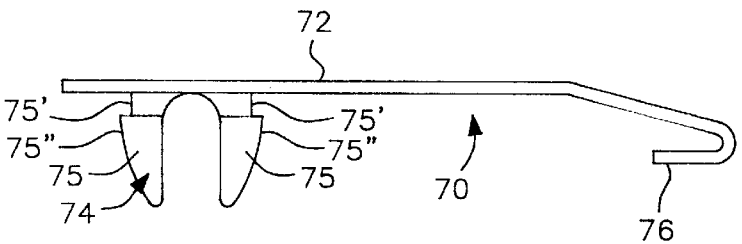
FIG. 5 is a side elevational view of the adaptor element of FIG. 4.

With reference to FIGS. 1A, 4A and 5A, wherein parts similar to the embodiments of FIGS. 1, 4 and 5 are designated with the same reference numerals followed by a suffix "a", the integral push pins 74*a* are substantially narrower than the push pins 74 to enable the same to be engaged in the circular openings 44 of a shelf such as shown in 40 in FIG. 1, or diamond-shaped opening 44*a* as shown in the shelf 40*a* in FIG. 1A. This simple modification in the design of the push pins makes the adaptor 70*a* useful in shelves having different shaped openings, avoiding the need to substitute individual adaptors to accommodate the shape of the openings in particular shelves.

Figure 5B:
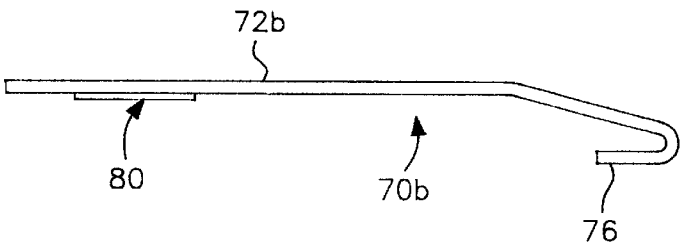
FIG. 5B is a side elevational view of yet another modified adaptor element for use with a shelf having no through-openings in its product supporting surface.

On the other hand, should the product supporting surface of the shelf have no openings, an adaptor such as shown at 70*b* in FIG. 5B can be utilized, wherein the push pins are totally eliminated and replaced with one or more stripes or spots of an adhesive material 80. While adhesive materials, and the attendant disadvantages discussed above, are generally unnecessary with the label holder of this invention, the relatively limited areas of such materials needed to attach an adaptor to an imperforate shelf surface are tolerable.

The various elements, as well as the materials from which these elements are formed, can be readily modified without departing from the instant inventive concepts. It will be seen that, since the individual adaptor elements may be relatively narrow as compared to the widths of a label or label/sign holder usually marketed, such adaptors need only be secured to the flange 32 of the cover member 18 of a label holder at selected locations along its length to secure the upper portions to the shelf. Obviously, with a label/sign holder of extended widths, perhaps four feet or more, a multiplicity of adaptors 70 can be utilized at spaced locations.

Moreover, although the adaptor elements of this invention are particularly designed for use in engaging a locking lip at the top of a back panel of a label holder as seen in U.S. Pat. No. 5,515,632, it will function effectively with any label holder having a lip, or the like, at its upper edges.

Figure 2:
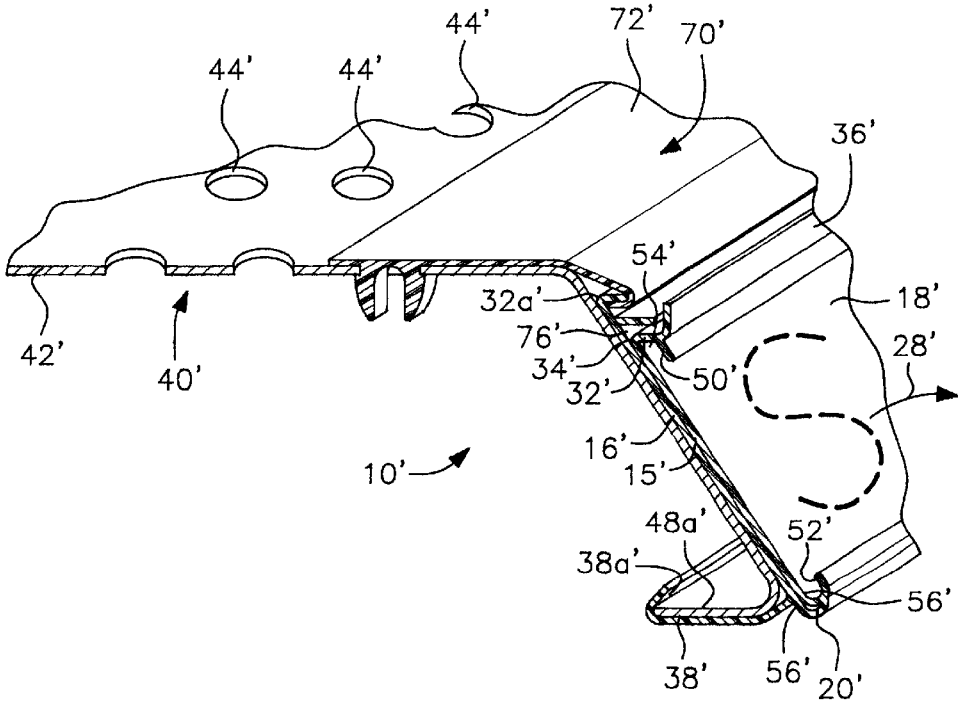
FIG. 2 is a view similar to FIG. 1 with a modified label/sign holder providing additional versatility in use.

The embodiment of FIG. 2 is a modification of the system shown in FIG. 1, wherein like parts have been identified with the same reference numeral followed by a prime (′). The only difference between the label/sign holder 10′ of FIG. 2 and the label/sign holder 10 of FIG. 1 is the incorporation of an additional lip or flange 32*a*′ on an extended portion of the body panel 16′. Such an extra flange is also shown in dotted lines at 32*a* in FIG. 1. This additional flange provides two functions. First, it enables the label/sign holder 10′ to be fitted to shelves 40′ having a front lip 46′ of varying dimensions since the reverted lip or hook 76′ of the adaptor 70′ can be engaged either with the flange 32′ or the flange 32*a*′. Moreover, engagement of the reverted portion 76′ of the adaptor 70′ in the upper flange 32*a*′ of the label/sign holder 10′ precludes any interference between the reverted portion 76′ of the adaptor 70′ and the interlocking engagement between the flange 32′ on the base panel member 16′ and the upper edge portions 34′ of the cover member 18′.

The previous discussions have dealt primarily with the manner in which the upper end of the body panel of a label or label/sign holder is retained by an adaptor element to secure the same to the front edge of a shelf lacking a C-channel, for the most part, without the need for adhesive materials. The label/sign holder of the previous embodiments include a lower flange 38 with a reverted rear edge 38*a* to underlie, wrap-around and capture the rearwardly extending shelf flange 48. While this construction functions effectively, it is sometimes difficult to retain the engagement of the reverted edge lip 38*a* over the rear edge 48*a* of the shelf flange 48, while capturing the base panel lip 32 by the hook member 76 on the adaptor element 70. While adhesive could be used to secure a lower flange on the label/sign holder to the undersurface of the shelf flange thereby avoiding the need for retaining the engagement of the reverted edge as noted above, this invention generally prefers to avoid the use of adhesive for a variety of reasons. Therefore, a number of alterative means are illustrated in FIGS. 6–16, to anchor the lower end of the label holder to the shelf in a way that facilitates engaging the body panel lip with the hook member on the adaptor element.

In each of these embodiments, the upper portions of the label/sign holder are identical to the label/sign holder 10 in FIG. 1 and are secured to the shelf 40 by an adaptor element such as the element 70 of FIG. 1. It is to be understood, however, that variations on the label/sign holder, such as the addition of a second flange 32*a* as in FIG. 2, as well as variations in the type of adaptor element such as the elements 70*a* of FIGS. 1A, 4A and 5A or 70*b* of FIG. 5B, may readily be substituted therefor.

Figure 6:
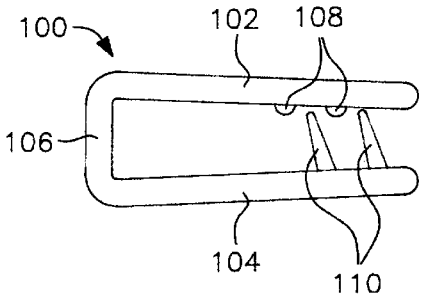
FIG. 6 is a side elevational view of a clip element used in one embodiment of this invention to secure a rearwardly extending flange on the back of the body panel of a label holder to the shelf lower edge flange.
Figure 7:
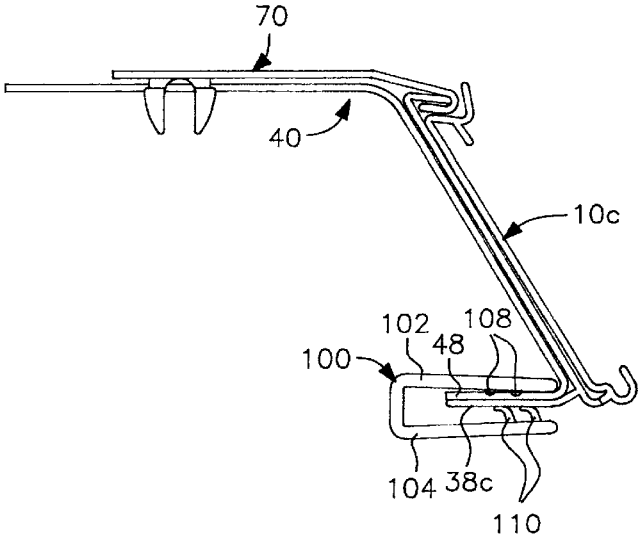
FIG. 7 is a side elevational view of the clip element of FIG. 6 in use.

In the embodiment of FIGS. 6 and 7, wherein parts similar to the previous embodiments are identified by like reference characters followed by the suffix "c", the body panel flange 38*c* of the label/sign holder 10*c* does not have a reverted edge such as seen at 38*a* in FIG. 1. This avoids the need to engage the same over the shelf flange 48. Instead, one or more U-shaped clips 100 formed of plastic or metal and comprising a pair of legs 102, 104 interconnected by a resilient bight 106 are provided, the inner surfaces of the legs 102, 104 carrying beads, spots or strips of relatively soft, resilient plastic material 108 on one side and flexible fingers 110 on the other side to hold the flanges 38*c*, 48 securely while the remainder of the assembly is completed.

Figure 8:
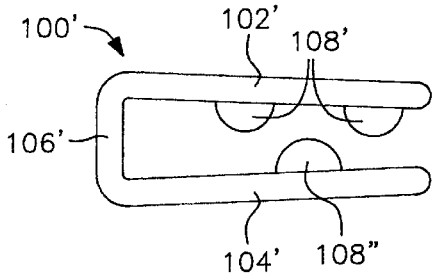
FIG. 8 is a side elevational view of a modified clip element.
Figure 9:
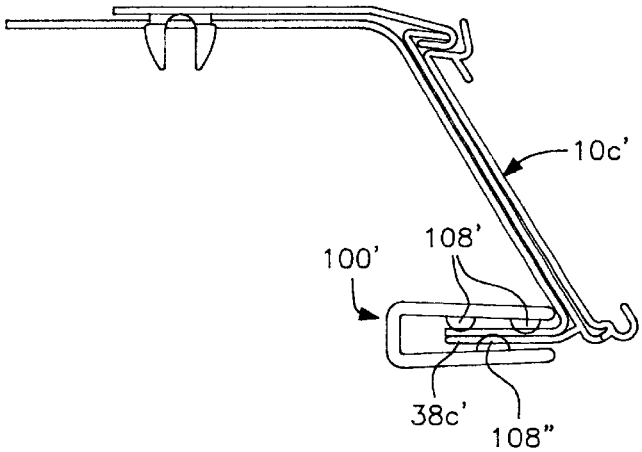
FIG. 9 is a view similar to FIG. 7, but showing use of the modified clip element of FIG. 8.

In the embodiment of FIGS. 8 and 9, wherein parts similar to the embodiment of FIGS. 6 and 7 are designated by the same reference characters followed by a prime (′), the resilient fingers 110 are replaced by additional beads, spots or stripes of resilient material 108″. Otherwise, this embodiment works in the same manner as the embodiment of FIGS. 6 and 7.

Figure 9A:
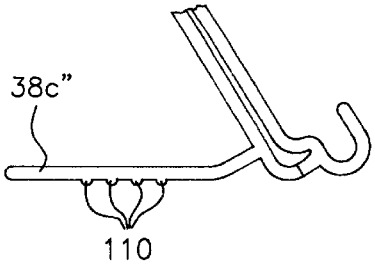
FIG. 9A is a fragmentary view of a modified lower flange on the label/sign holder to better grip a clip element such as seen in FIG. 8.

The body panel lower flange of the label/sign holder can be modified as shown at 38*c*″ in FIG. 9A to include a series of spaced ridges or bumps 112 on its lower surface to interengage with the resilient element or elements 108″.

Figure 10:
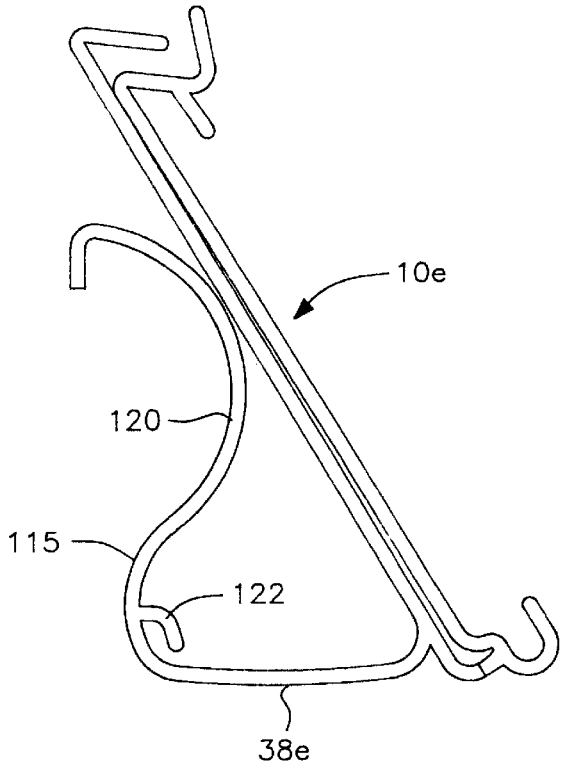
FIG. 10 shows an alternate form of label/sign holder wherein a clip-like connector such as seen in FIGS. 8 and 9 is integrally formed on the rearwardly extending flange of the label holder.

In FIG. 10, wherein parts similar to the previous embodiments are designated by the same reference numeral followed by the suffix "d", the rearwardly extending flange 38*d* of the label/sign holder 10*d* includes an integral clip-like reverted end portion 38*d*′ which captures the rear end of the shelf flange 48 and securely holds the same by virtue of the lines or spots of resilient material 108*d* thereby avoiding the need for discrete clip elements such as seen in FIGS. 6–9.

Figure 11:
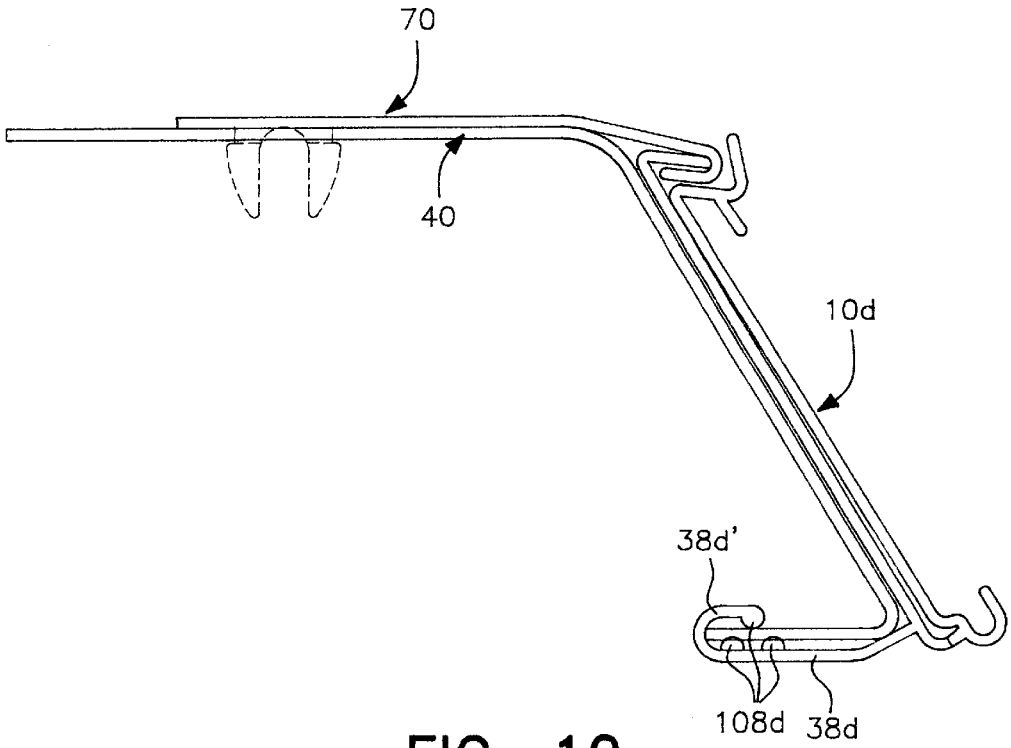
FIG. 11 is a side elevational view of yet another modification of a label/sign holder according to this invention.
Figure 12:
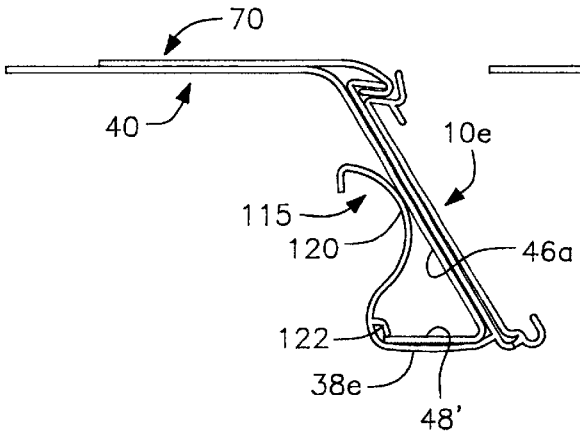
FIG. 12 schematically illustrates the label/sign holder of FIG. 11 in combination with a shelf and adaptor element.

In FIGS. 11 and 12, wherein parts similar to the previous embodiments are designated with a suffix "e", the rearwardly extending flange 38*e* on the label/sign holder 10*e* includes an extended tail 115 defining an arcuate rear portion 120 which resiliently engages the rear surface 46*a* of the shelf lip 46, with an inwardly extending finger 122 which sits on the upper surface 48′ of the shelf flange 48.

Figure 13:
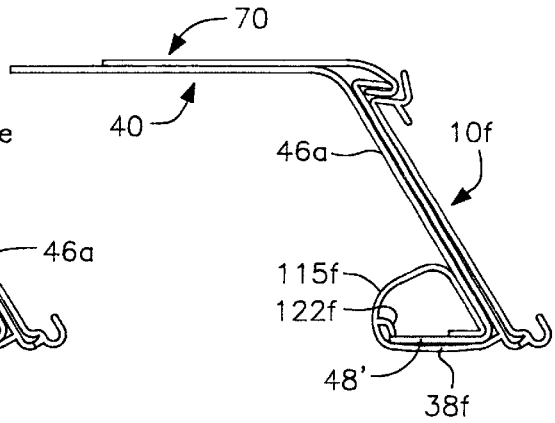
FIGS. 13–16 illustrate further embodiments of label/sign holders incorporating variations of the elements adapted to secure the lower portions thereof to a shelf.

In FIG. 13, wherein similar parts are designated with a suffix "f", the rearwardly extending tail 115*f* of the flange 38*f* of the label/sign holder 10*f* curls back on itself to fit within the crotch formed between the rear surface 46*a* of the shelf lip 46 and the upper surface 48′ of the shelf flange 48.

Figure 14:
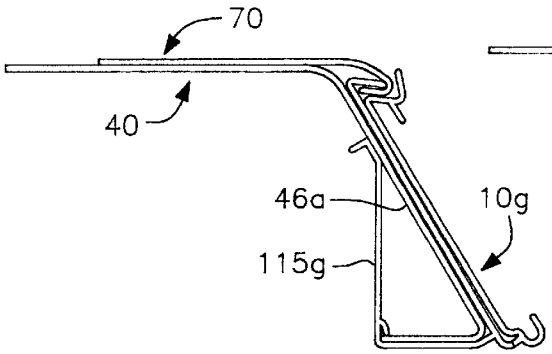

In FIG. 14 where the parts are designated by a suffix "g", the tail 115*g* of the flange 38*g* of the label/sign holder 10*g* extends upwardly and engages against the rear surface 46*a* of the shelf lip 46.

Figure 15:
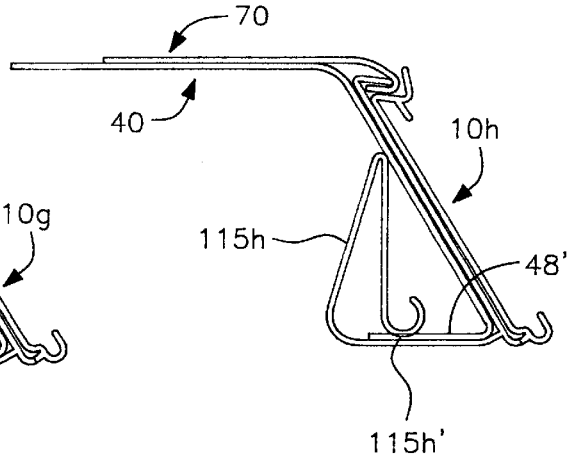

In FIG. 15, wherein the parts are designated by a suffix "h", the tail element 115*h* extends back downwardly to a terminal arcuate portion 115*h*′ which engages against top surface 48′ of the shelf 40.

Figure 16:
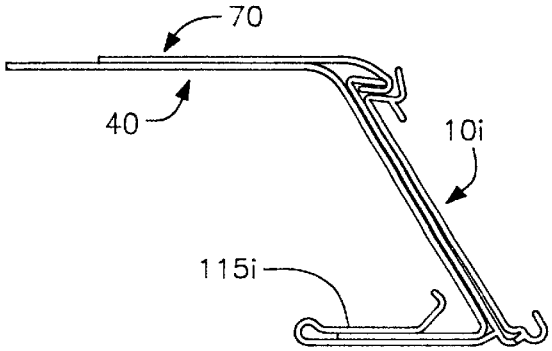

Finally, in FIG. 16, wherein the parts are designated by a suffix "i", the tail extension 115′ of the reverted end of the flange 38*i* extends toward the rear surface 46*a* of the shelf lip 46 for an extended distance in order to provide a better grip thereon.

These variations on the lower shelf-engaging portion of the label or label/sign holder will suggest other modifications well within the skill of the ordinary artisan. Of importance, however, is that both the lower and upper portions of the label or label/sign holder are securely affixed to the front edge of a shelf of the type described which lacks a C-channel to maintain the same in position without interfering with the movement of the transparent cover member for inserting or removing a label. Yet, the various embodiments disclosed herein, except in rare instances, totally avoid the need for adhesive materials so that the elements can be readily removed for replacement or for attachment to shelves in another location.

To reiterate, although the adaptor 70 of this invention has been illustrated herein in combination with a label/sign holder of the type seen in the '588 application, it is obvious that similar designs can be equally adapted to secure a label holder without an integral sign holder or, for that matter, a label holder without a locking cover, so long as the base panel of the label holder includes an upper flange element or lip that can be captured by the IS reverted portion or hook 74 of the adaptor 70. Moreover, although the designs disclosed herein are particularly adapted to secure a label or label/sign holder to a shelf devoid of a C-channel, similar elements could be used even if the shelf included a C-channel, avoiding some of the more complicated structures necessary to secure the same to the C-channel, or securing a label or label/sign holder to a shelf with a C-channel when the channel-engaging means are not included or are broken.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. In a label holder for attachment to a shelf wherein the shelf includes a generally horizontally extending portion with an upper supporting surface adapted to carry merchandise for display, and a front edge, a shelf lip extending downwardly from the front edge of the supporting surface and having a front surface, a rear surface, and a lower edge, and a shelf flange extending rearwardly from the lower edge of the shelf lip and having an upper surface, a lower surface, a front edge and a rear edge, and wherein the label holder includes a top, a bottom, a front and a rear, a main body panel defining the rear of the label holder, and a transparent cover member defining the front of the label holder, the body panel and the cover member each having an upper portion, a lower portion, a front surface and a rear surface, the lower portions of the body panel and the cover member being resiliently interconnected to define a hinge therebetween, and a label-receiving pocket defined between the front surface of the body panel and the rear surface of the cover member, the improvement which comprises, means for securing the label holder to the shelf, said means including a label holder flange on the lower portion of the rear surface of the body panel adapted to be secured to or about the shelf flange, and an adaptor element including a generally planar rearward portion with an undersurface, and means for securing said adaptor element to the shelf with said undersurface of said rearward portion of said adaptor element contacting the supporting surface of the shelf, and a forward portion of said adaptor element adapted to extend beyond the front edge of the supporting surface of the shelf, said forward portion of said adaptor element defining a downwardly extending hook member, and a forwardly and downwardly depending body panel lip defined at least partially along the upper portions of the body panel of the label holder, said hook member of said adaptor element being adapted for removable engagement with said body panel lip to secure the upper portion of the body panel against movement relative to the shelf while permitting the cover member to be selectively moved forwardly about the hinge for inserting or removing labels from the pocket to provide visual access to information on the labels relating to merchandise carried by the shelf supporting surface through the transparent cover member.

2. The improvement of claim 1 wherein the front surface of the shelf lip is generally planar and the rear surface of the body panel of the label holder is adapted to rest against the front surface of the shelf lip in use.

3. The improvement of claim 2 wherein the front surface of the shelf lip extends at an angle forwardly and downwardly between the front edge of the shelf supporting surface and the front edge of the shelf flange.

4. The improvement of claim 1 wherein the cover member has a height such that a top edge of the cover member can be releasably engaged behind said body panel lip, and a forwardly extending channel-shaped formation is formed along the top edge of the cover member comprising an inner downwardly extending limb and an outer upwardly extending limb between which limbs said body panel lip is received when the top edge of the cover member is thus engaged, said body panel lip having a lower edge and said outer limb having an upper edge spaced outwardly from said body panel lip above said lower edge of said body panel lip to define an open channel-like formation between said body panel lip and said outer limb, said outer limb forming a gripping element by which the top edge of the cover member can be disengaged from behind said body panel lip by finger pressure exerted from above downwardly and outwardly on said upper edge of said outer limb.

5. The improvement of claim 4, further including portions of the body panel extending above said body panel lip to define an upper edge, and a further body panel lip defined at least partially along said upper edge of the body panel in spaced relationship to said first-mentioned body panel lip to enable said hook member of said adaptor element to be selectively engaged with either of said body panel lips to secure the upper portion of said body panel against movement relative to the shelf.

6. The improvement of claim 1 further including sign-holder supporting members carried substantially entirely by the front surface of the cover member for removably receiving at least one sign holder adapted to display an information-containing sign forwardly of the label holder.

7. The improvement of claim 1 wherein said means for securing said adaptor element to the shelf includes adhesive on portions of said undersurface of said rearward portion of said adaptor element.

8. The improvement of claim 1 wherein the horizontally extending portion of the shelf includes a plurality of through-apertures, and said means for securing said adaptor element to the shelf includes at least one push pin adapted to resiliently engage in a selected aperture.

9. The improvement of claim 8 wherein said push pin is integrally formed on said undersurface of said rearward portion of said adaptor element.

10. The improvement of claim 9 wherein each of said push pins includes a pair of spaced legs each having an upper end resiliently secured to said undersurface of said rearward portion of said adaptor element, each leg having a reduced cross-section portion at the point where it is secured to said adaptor element, and an enlarged portion merging into a freely extending lower tip, the normal spacing between said enlarged portions of each pair of legs being larger than a dimension of the shelf apertures perpendicular to the front edge of the supporting surface, and the spacing between said reduced cross-section portions of said pair of legs being less than said dimension.

11. The improvement of claim 10 wherein the spacing between said reduced cross-section portions of said pair of legs of said push pins is greater than the width of said legs transverse to said spacing.

12. The improvement of claim 10 wherein the shelf apertures are circular.

13. The improvement of claim 11 wherein the shelf apertures are diamond-shaped.

14. The improvement of claim 1 wherein said means for securing the label holder to the shelf includes the label holder flange extending rearwardly from the lower portion of the body panel and having an upper surface adapted to underlie the lower surface of the shelf flange in use.

15. The improvement of claim 14 further including a reverted portion at the rear of said label holder flange adapted to engage around the rear edge of the shelf flange.

16. The improvement of claim 15 wherein the reverted portion of the label holder flange defines a pocket adapted to capture the rear edge portion of the shelf flange.

17. The improvement of claim 16 wherein the label holder flange pocket is formed between the upper surface of the label holder flange and the lower surface of a tail portion of said label holder flange which extends back toward the rear surface of the shelf lip in use.

18. The improvement of claim 17 further including relatively soft sections of plastic material carried by the opposing surfaces defining said label holder flange pocket to grip opposite sides of the shelf flange.

19. The improvement of claim 17 wherein said tail portion of said label holder flange include a downwardly directed finger having a terminal portion adapted to engage the upper surface of the shelf flange adjacent the rear edge of the shelf flange in use.

20. The improvement of claim 17 wherein the tail portion of said label holder flange extends upwardly to define a surface adapted to resiliently engage the rear surface of the shelf lip in use.

21. The improvement of claim 20 wherein the tail portion of said label holder flange further includes a terminal portion extending downwardly and adapted to resiliently engage the upper surface of the shelf flange in use.

22. The improvement of claim 17 wherein said tail portion of said label holder flange is curved back on itself to form a generally U-shaped terminal portion adapted to resiliently seat in a crotch formed between the rear surface of the shelf lip and the upper surface of the shelf flange in use.

23. The improvement of claim 14 further including at least one discrete, generally U-shaped, clip member, each of said clip members including a pair of spaced leg elements having opposed surfaces adapted to resiliently secure said label holder flange to the shelf flange in use.

24. The improvement of claim 23 further including gripping means on said opposed surfaces of said leg elements of said clip member.

25. The improvement of claim 24 wherein said gripping means includes spaced flexible fingers on at least one of said leg elements.

26. The improvement of claim 24 wherein said gripping means includes relatively soft sections of plastic material on at least one of said leg elements.

27. The improvement of claim 26 wherein said gripping means includes relatively soft sections of plastic material on both opposing surfaces of said leg elements.

28. The improvement of claim 24 further including a plurality of spaced ridges defined on said lower surface of said label holder flange to engage said gripping means.

29. In combination, a merchandise-supporting shelf and a label holder, said shelf including a generally horizontally extending portion with an upper supporting surface adapted to carry merchandise for display, and a front edge, a shelf lip extending downwardly from said front edge of said supporting surface and having a front surface, a rear surface, and a lower edge, and a shelf flange extending rearwardly from said lower edge of said shelf lip and having an upper surface, a lower surface, a front edge and a rear edge, and wherein said label holder includes a top, a bottom, a front and a rear, a main body panel defining said rear of said label holder, and a transparent cover member defining said front of said label holder, said body panel and said cover member each having an upper portion, a lower portion, a front surface and a rear surface, said lower portions of the body panel and the cover member being resiliently interconnected to define a hinge therebetween, and a label-receiving pocket defined between said front surface of said body panel and said rear surface of said cover member, further including means securing said label holder to said shelf, said means including a label holder flange on said lower portion of said rear surface of said body panel secured to or about said shelf flange, and an adaptor element including a generally planar rearward portion with an undersurface, and means securing said adaptor element to said shelf with said undersurface of said rearward portion of said adaptor element contacting said supporting surface of said shelf, and a forward portion of said adaptor element extending beyond said front edge of said supporting surface of said shelf, said forward portion of said adaptor element defining a downwardly extending hook member, and a forwardly and downwardly depending body panel lip defined at least partially along said upper portions of said body panel of said label holder, said hook member of said adaptor element being removably engaged with said body panel lip to secure said upper portion of said body panel against movement relative to said shelf while permitting said cover member to be selectively moved forwardly about said hinge for inserting or removing labels from said pocket to provide visual access to information on the labels relating to merchandise carried by said shelf supporting surface through said transparent cover member.

30. The combination of claim 29 wherein said front surface of the shelf lip is generally planar and said rear surface of said body panel of said label holder rests against said front surface of said shelf lip.

31. The combination of claim 30 wherein said front surface of said shelf lip extends at an angle forwardly and downwardly between said front edge of said shelf supporting surface and said front edge of said shelf flange.

32. The combination of claim 29 wherein said cover member has a height such that a top edge of said cover member can be releasably engaged behind said body panel lip, and a forwardly extending channel-shaped formation is formed along the top edge of the cover member comprising an inner downwardly extending limb and an outer upwardly extending limb between which limbs said body panel lip is received when the top edge of the cover member is thus engaged, said body panel lip having a lower edge and said outer limb having an upper edge spaced outwardly from said body panel lip above said lower edge of said body panel lip to define an open channel-like formation between said body panel lip and said outer limb, said outer limb forming a gripping element by which said top edge of the cover member can be disengaged from behind said body panel lip by finger pressure exerted from above downwardly and outwardly on said upper edge of said outer limb.

33. The combination of claim 32, further including portions of said body panel extending above said body panel lip to define an upper edge, and a further body panel lip defined at least partially along said upper edge of said body panel in spaced relationship to said first-mentioned body panel lip to enable said hook member of said adaptor element to be selectively engaged with either of said body panel lips to secure the upper portion of said body panel against movement relative to said shelf.

34. The combination of claim 29 further including sign-holder supporting members carried substantially entirely by said front surface of said cover member for removably receiving at least one sign holder adapted to display an information-containing sign forwardly of the label holder.

35. The combination of claim 29 wherein said means securing said adaptor element to said shelf includes adhesive on portions of said undersurface of said rearward portion of said adaptor element.

36. The combination of claim 29 wherein said horizontally extending portion of said shelf includes a plurality of through-apertures, and said means for securing said adaptor element to said shelf includes at least one push pin resiliently engaged in a selected aperture.

37. The combination of claim 36 wherein said push pin is integrally formed on said undersurface of said rearward portion of said adaptor element.

38. The combination of claim 37 wherein each of said push pins includes a pair of spaced legs each having an upper end resiliently secured to said undersurface of said rearward portion of said adaptor element and an enlarged portion merging into a freely extending lower tip, each leg having a reduced cross-section portion at the point where it is secured to said adaptor element, the normal spacing between said enlarged portions of each pair of legs being larger than a dimension of said shelf apertures perpendicular to said front edge of said supporting surface, and said spacing between said reduced cross-section portions of said pair of legs is less than said dimension.

39. The combination of claim 38 wherein said spacing between said reduced cross-section portions of said pair of legs of said push pins is greater than the width of said legs transverse to said spacing.

40. The combination of claim 38 wherein said shelf apertures are circular.

41. The combination of claim 39 wherein said shelf apertures are diamond-shaped.

42. The combination of claim 29 wherein said means securing said label holder to said shelf includes the label holder flange extending rearwardly from said lower portion of said body panel and having an upper surface underlying said lower surface of said shelf flange.

43. The combination of claim 42 further including a reverted portion at the rear of said label holder flange engaging around said rear edge of said shelf flange.

44. The combination of claim 43 wherein said reverted portion of said label holder flange defines a pocket capturing said rear edge portion of said shelf flange.

45. The combination of claim 44 wherein said label holder flange pocket is formed between said upper surface of said label holder flange and the lower surface of a tail portion of said label holder flange which extends back toward said rear surface of said shelf lip.

46. The combination of claim 45 further including relatively soft sections of plastic material carried by the opposing surfaces defining said label holder flange pocket to grip opposite sides of said shelf flange.

47. The combination of claim 45 wherein said tail portion of said label holder flange include a downwardly directed finger having a terminal portion engaging said upper surface of said shelf flange adjacent said rear edge of the shelf flange.

48. The combination of claim 45 wherein said tail portion of said label holder flange extends upwardly to define a surface resiliently engaging said rear surface of said shelf lip.

49. The combination of claim 48 wherein said tail portion of said label holder flange further includes a terminal portion extending downwardly and resiliently engaging said upper surface of said shelf flange.

50. The combination of claim 45 wherein said tail portion of said label holder flange is curved back on itself to form a generally U-shaped terminal portion resiliently seating in a crotch formed between said rear surface of said shelf lip and said upper surface of said shelf flange.

51. The combination of claim 42 further including at least one discrete, generally U-shaped, clip member, each clip member including a pair of spaced leg elements having opposed surfaces resiliently securing said label holder flange to said shelf flange.

52. The combination of claim 51 further including gripping means on said opposed surfaces of said leg elements of said clip member.

53. The combination of claim 52 wherein said gripping means includes spaced flexible fingers on at least one of said leg elements.

54. The combination of claim 52 wherein said gripping means includes relatively soft sections of plastic material on at least one of said leg elements.

55. The combination of claim 54 wherein said gripping means includes relatively soft sections of plastic material on both opposing surfaces of said leg elements.

56. The combination of claim 52 further including a plurality of spaced ridges defined on said lower surface of said label holder flange to engage said gripping means.

* * * * *